US009074157B2

(12) United States Patent
Tipton et al.

(10) Patent No.: US 9,074,157 B2
(45) Date of Patent: Jul. 7, 2015

(54) POLYMERIC PHOSPHORUS ESTERS FOR LUBRICANT APPLICATIONS

(75) Inventors: Craig D. Tipton, Perry, OH (US); Charla A. Ramsey, Concord Township, OH (US); Daniel J. Knapton, Willowick, OH (US); Paul E. Adams, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 912 days.

(21) Appl. No.: 13/266,487

(22) PCT Filed: Apr. 21, 2010

(86) PCT No.: PCT/US2010/031880

§ 371 (c)(1),
(2), (4) Date: Aug. 9, 2012

(87) PCT Pub. No.: WO2010/126760

PCT Pub. Date: Nov. 4, 2010

(65) Prior Publication Data

US 2013/0079264 A1 Mar. 28, 2013

Related U.S. Application Data

(60) Provisional application No. 61/174,029, filed on Apr. 30, 2009.

(51) Int. Cl.

| | |
|---|---|
| ***C10M 159/12*** | (2006.01) |
| ***C10M 153/00*** | (2006.01) |
| ***C10M 137/12*** | (2006.01) |

(52) U.S. Cl.

CPC ..... *C10M 137/12* (2013.01); *C10M 159/123* (2013.01); *C10M 153/00* (2013.01); *C10M 2225/00* (2013.01); *C10N 2230/06* (2013.01); *C10N 2230/36* (2013.01); *C10N 2240/04* (2013.01); *C10N 2240/042* (2013.01)

(58) Field of Classification Search

USPC ..... 508/426

See application file for complete search history.

(56) References Cited

U.S. PATENT DOCUMENTS

| | | | | |
|---|---|---|---|---|
| 3,228,998 | A | 1/1966 | Fierce et al. | |
| 3,328,360 | A | 6/1967 | Rozanski et al. | |
| 4,163,767 | A | 8/1979 | Giolito | |
| 4,298,481 | A | 11/1981 | Clarke | |
| 4,532,057 | A * | 7/1985 | Horodysky et al. | 508/422 |
| 4,549,976 | A | 10/1985 | Horodysky et al. | |
| 4,557,845 | A | 12/1985 | Horodysky et al. | |
| 4,704,218 | A | 11/1987 | Horodysky et al. | |
| 5,443,744 | A | 8/1995 | Bloch et al. | |
| 5,773,392 | A * | 6/1998 | Romanelli et al. | 508/348 |
| 5,968,880 | A | 10/1999 | Mathur et al. | |
| 5,972,851 | A * | 10/1999 | Srinivasan et al. | 508/188 |
| 6,103,673 | A | 8/2000 | Sumiejski et al. | |
| 6,251,840 | B1 | 6/2001 | Ward, Jr. et al. | |
| 6,451,745 | B1 | 9/2002 | Ward | |
| 6,528,458 | B1 | 3/2003 | Tagliamonte et al. | |
| 6,730,640 | B2 | 5/2004 | Sowerby et al. | |
| 2010/0063311 | A1 * | 3/2010 | Mack et al. | 558/110 |

OTHER PUBLICATIONS

Corresponding PCT Publication No. WO 2010/126760 A2 published Nov. 4, 2010.

Written Opinion from corresponding international application No. PCT/US2010/031880 mailed Jul. 7, 2010.

Search Report from corresponding international application No. PCT/US2010/031880 mailed Jul. 7, 2010.

* cited by examiner

*Primary Examiner* — James Goloboy

(74) *Attorney, Agent, or Firm* — David M. Shold

(57) ABSTRACT

A lubricant composition of an oil of lubricating viscosity and a polymeric phosphorus ester comprising the condensation product of a monomeric phospho¬ rus acid or an ester thereof with a diol having two hydroxy groups separated by a chain of 4 to about 100 atoms exhibits good volatility, corrosion, wear, and/or seal performance in lubrication of a transmission.

20 Claims, No Drawings

POLYMERIC PHOSPHORUS ESTERS FOR LUBRICANT APPLICATIONS

BACKGROUND OF THE INVENTION

The disclosed technology relates to oligomeric or polymeric phosphites and their use in lubricant formulations, including lubricants for driveline applications.

Phosphorus esters of various types are well known for their use as lubricant additives. For example, U.S. Pat. No. 6,730,640, Sowerby et al., May 4, 2004, discloses a method for lubricating a continuously variable transmission. The lubricant is a fluid composition which comprises an oil of lubricating viscosity and an oil-soluble zinc salt, which may be a zinc hydrocarbyl phosphate. The zinc hydrocarbyl phosphate can be prepared by reacting phosphorus acid or anhydride with an alcohol, followed by neutralization with a zinc base. The alcohols may be monohydric alcohols, or polyhydric alcohols such as alkylene polyols such as ethylene glycols, including di-, tri- and tetraethylene glycols; propylene glycols, including di-, tri- and tetrapropylene glycols; glycerol; and the like. Additional additives may also be present, such as other friction modifiers and phosphorus-containing antioxidants.

U.S. Pat. No. 4,557,845, Horodysky et al., Dec. 10, 1985, discloses products of reaction between a 2-hydroxyalkylalkylamine or certain higher oxylated members, and a dihydrocarbyl phosphite as friction reducers and fuel reducing additives for internal combustion engines when such products are compounded with lubricant and liquid fuels. Among the reaction products are compounds such as

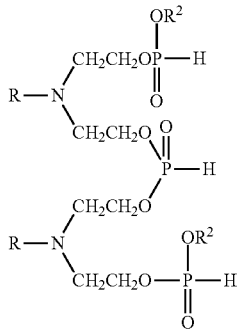

where R is a $C_6$ to $C_{30}$ hydrocarbyl group.

U.S. Pat. No. 4,298,481, Clarke, Nov. 3, 1981, discloses high temperature grease composition which contains a load bearing component. Useful load-bearing additives include polyphosphates including those of the structure $$(R_1O)(R_2O)P—OR_3O—[—O—P(OR_4)—OR_5O—]_n—P(OR_6)(OR_7)\text{[sic]}$$

$R_3$ and $R_5$ are polyalkylene glycol, alkylidene bisphenol, hydrogenated alkylidene bisphenol, or ring-halogenated alkylidene bisphenol from which the two terminal hydrogens have been removed; n is an integer in the range of 1 to 18.

U.S. Pat. No. 4,704,218, Horodysky et al., Nov. 3, 1987, discloses the reaction products of long chain vicinal diols containing at least 10 carbon atoms and one or more sulfur atoms in the chain, with a dihydrocarbyl hydrogen phosphate containing 1 to 6 carbon atoms in each hydrocarbyl group, as effective friction-reducing antiwear additives in lubricating oils, greases and fuels.

U.S. Pat. No. 5,968,880, Mathur et al., Oct. 19, 1999, discloses lubricating compositions and a metal-free thiophosphorus acid ester which contains at least one hydrocarbyl terminated oxyalkylene group or hydrocarbyl terminated polyoxyalkylene group. The ester may be represented by the formula $$(R_1—(OR_2)_x—X_2)_{3-a}—P(=X_1)—(X_3R_3)_a$$

where $R_1$ is a hydrocarbyl group, $R_2$ is an alkylene group, and $R_3$ is hydrogen or a hydrocarbyl group. Also disclosed are salts of such thiophosphorus acid esters, including amine salts, e.g., hydroxylamine salts.

U.S. Pat. No. 6,103,673, Sumiejski et al., Aug. 15, 2000, discloses compositions containing friction modifiers for continuously variable transmissions, which include at least 0.1 percent by weight of at least one phosphorus compound. The phosphorus compound can be a phosphorus acid or ester of the formula $(R^1X)(R^2X)P(X)_nX_mR^3$ where $R^1$, $R^2$, and $R^3$ are hydrogen or hydrocarbyl groups. $R^1$ and $R^2$ groups can comprise a mixture of hydrocarbyl groups derived from commercial alcohols, examples being monohydric alcohols.

Other patents with related disclosures include U.S. Pat. No. 6,528,458, Tagliamonte et al., Mar. 4, 2003; U.S. Pat. No. 6,451,745, Ward, Sep. 17, 2002, and U.S. Pat. No. 6,251,840, Ward et al., Jun. 27, 2001.

U.S. Pat. No. 4,163,767, Giolito, Aug. 7, 1979, disclose a polyphosphorous mixed phosphite-phosphonate polymer flame retardant, especially for urethane foams.

One problem encountered with low molecular weight phosphites such as dialkyl (e.g., dibutyl) phosphites (sometime referred to as dialkyl hydrogen phosphites) is that they may readily absorb into elastomeric seals where they may subsequently lead to acid formation causing degradation of the seal material. The disclosed technology provides higher molecular weight, oligomeric or polymeric phosphites which provide phosphorus and consequent antiwear performance properties to lubricant formulations, while providing a lubricant having at least one of the properties of reduced degradation of elastomeric seals, reduced odor, reduced toxicity, reduced volatility, and reduced corrosion.

SUMMARY OF THE INVENTION

The disclosed technology provides a method for lubricating a drivetrain component, such as a transmission, comprising supplying thereto a lubricant composition comprising: (a) an oil of lubricating viscosity and (b) a polymeric phosphorus ester other than a zinc salt, comprising the condensation product of (i) a monomeric phosphorus acid or an ester thereof with (i) a diol wherein the two hydroxy groups of said diol are separated by a chain of 4 to 100 carbon atoms, said chain optionally including one or more oxygen or sulfur atoms, said polymeric phosphorus ester containing at least three phosphorus-containing monomer units.

In one embodiment, the diol is an alkylene diol and the two hydroxy groups of the alkylene diol are separated by a chain of 4 to 20 carbon atoms.

The present invention further provides for the use of the lubricant composition set forth herein to improve seal and/or wear performance in a transmission lubricated therewith.

DETAILED DESCRIPTION OF THE INVENTION

Various preferred features and embodiments will be described below by way of non-limiting illustration.

The lubricant compositions as disclosed herein include, as one component, an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Natural oils useful in making the disclosed lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined, and rerefined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation. The oil can also be an oil derived from hydroisomerization of wax such as slack wax or a Fischer-Tropsch synthesized wax.

Other oils are materials commonly known as traction fluids. These include polymers of at least one olefin containing 3 to 5 carbon atoms; hydrocarbon molecules containing non-aromatic cyclic moieties; as fluids comprising naphthenic hydrocarbons having 19 carbon atoms, e.g., comprising two substituted cyclohexane rings linked by a methylene group; hydrogenated dimers of α-alkyl styrene; hydrogenated polyolefins and adamantane ethers.

In one embodiment, the oil of lubricating viscosity is an API Group II, Group III, Group IV, or Group V oil, including a synthetic oil, or mixtures thereof. These are classifications established by the API Base Oil Interchangeability Guidelines. Both Group II and Group III oils contain <0.03 percent sulfur and >90 percent saturates. Group II oils have a viscosity index of 80 to 120, and Group III oils have a viscosity index >120. Polyalphaolefins are categorized as Group IV. For completeness, we mention that Group I contains >0.03% S and/or <90% saturates and has a viscosity index of 80 to 120. Group V encompasses "all others."

In certain embodiments, the oil of lubricating viscosity may comprise a polyalphaolefin (PAO). Typically, polyalphaolefins are derived from monomers having 4 to 30, or 4 to 20, or 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present technology can encompass oils of a single viscosity range or a mixture of high viscosity and low viscosity range oils. In one embodiment, the oil exhibits a 100° C. kinematic viscosity of 1 or 2 to 8 or to 10 $mm^2/sec$ (cSt). The overall lubricant composition may be formulated using oil and other components such that the viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), for instance, less than 10 Pa-s, even 5 or less.

The formulations described herein will also contain a polymeric phosphorus ester. The term "polymeric" or "polymer" is intended to be interpreted broadly so as to include what might be referred to as oligomeric species, since it is well known that there is no rigid dividing line between an oligomer and a polymer. The polymers of the present invention will typically comprise molecules containing at least three or four or five or seven phosphorus-containing units. The upper limit of number of phosphorus units is not clearly defined, but in many instances may be 500 or less, or 100 or less, or 90 or less, or 50 or less, or 20 or less, for example 5 to 500 or 5 to 100 or 5 to 15 or 3 to 20 phosphorus-containing units.

The polymeric phosphorus esters are typically prepared by condensing a monomeric phosphorus acid or an ester thereof with a diol so as to form an oligomeric or polymeric ester structure. By "monomeric" phosphorus acid or ester is meant a phosphorus acid or ester, typically containing one phosphorus atom, which may be reacted with a diol in order to form the polymer.

Phosphorus acids include phosphoric acid and phosphorous acid and anhydrides thereof and sulfur-containing analogues thereof. Phosphorus esters include phosphites and phosphates and the sulfur-containing analogues thereof. Examples include dihydrocarbyl and trihydrocarbyl phosphites, believed to be represented by the structures $(RO)_2P(=O)H$ and $(RO)_3P$, respectively. Mixtures of di- and trihydrocarbyl phosphites may also be useful. In these materials, the R groups may be the same or different, and may typically be alkyl groups, each independently typically having 1 to 6 or 1 to 4 carbon atoms. Such groups include methyl, ethyl, n-propyl, i-propyl, n-butyl, and i-butyl groups and the various isomers of pentyl and hexyl groups, including cyclic isomers. In one embodiment, the alkyl groups are methyl groups. Alternatively, the R groups may encompass aryl groups. Examples of phosphites include dimethyl phosphite, diethyl phosphite, dipropyl phosphite, dibutyl phosphite, and triethyl phosphite.

The particular choice of phosphite may be significant, depending on reaction conditions, particularly for trialkylphosphites. For instance, trimethyl phosphite may be less desirable than certain other materials because of its low boiling point (111° C.) and consequent volatility. In order to successfully use such a material, a pressurized reaction vessel or other precautions may be undertaken, to avoid loss of reactant. On the other hand, dimethyl phosphite (dimethyl hydrogen phosphonate) may be more suitable in this regard because of its higher boiling point (170° C.). Higher homologues of either material will generally have correspondingly less volatility. On the other hand, lower R groups such as methyl may lead to easier removal of the resulting alcohol from the product, by distillation.

The phosphorus acid or ester will be reacted or condensed with one or more diols to form the polymeric phosphorus ester. The diol may, broadly, be a compound having two condensable hydroxy groups, separated by a chain of 4 to 20 atoms, which may be entirely carbon atoms or may also in certain embodiments include heteroatoms such as, in particular, oxygen atoms (that is, an ether structure) or sulfur atoms. The expression "a chain of 4 to 20 atoms" is intended to refer to the number of atoms connecting, in a linear fashion, the two hydroxy groups, not counting any atoms pendant from the chain or branching off of the chain. Thus, for example, 1,5-pentanediol, 3-methyl-1,5-pentanediol, and di(ethylene glycol) each have a chain of 5 atoms separating the two hydroxy groups. In the first two instances the chain is exclusively a 5 carbon chain, and in the third, the chain also contains an oxygen atom (in which case it is a chain of 4 carbon atoms). In certain embodiments the chain does not contain a nitrogen atom.

The diol may have 4 to 100 atoms, e.g., 4 to 100 or 4 to 50 or 4 to 40 or 4 to 20 carbon atoms, separating the hydroxy groups because such materials are more likely to form polymeric condensation products with the phosphorus acid or ester than are shorter chain diols. Diols having only 3 or 2 atoms in the separating chain are more likely to form cyclic condensates with the phosphorus compound, since such materials would have favored 5 or 6 membered rings. Longer chains are less likely to cyclize and more likely to form extended polymeric structures. The upper limit of the chain length is not rigidly determined, but a value of 20 atoms is selected for convenience and because there would not seem to be much advantage to using longer chains. Other suitable chain lengths include 4 to 10 or 5 to 8 or 6 to 7 atoms or carbon atoms.

It should be noted that formation of cyclic structures in the present products is not necessarily entirely undesirable. Rather, it is desired that polymerization (or oligomerization) does occur, and the extent, if any, of cyclization, should not be so extensive as to prevent the polymerization. Thus, an appropriately small amount diol material having 2 or 3 atoms separating the hydroxy groups may be employed, provided that it does not substantially interfere with the polymer formation.

If the diol is an alkylene diol, it may contain 4 to 20 or 4 to 10 or 5 to 8 or 6 to 7 carbon atoms. The carbon chain may be linear or branched, and if branched, the total number of carbon atoms may be increased by the number of carbon atoms in the branches. Such branches may be, for instance, methyl or ethyl. Examples of such alkylene diols include butanediol and hexanediol.

Suitable diols which contain oxygen atoms in the chain separating the two hydroxy groups include diethylene glycol and triethylene glycol and homologues thereof, for instance, based on ethylene glycol or propylene glycol, e.g., polyethylene glycol.

The dihydroxy compound (diol) may, if desired, have additional hydroxy groups, that is, more than two per molecule, or there may be exactly two. Thus, materials such as glycerol may be included in the reaction under appropriate conditions. However, if there are more than two hydroxy groups, care should be taken to assure that there is no excessive cyclization such as might interfere with the polymerization reaction, if there are fewer than 4 atoms separating any of the hydroxy groups. Also, care should be taken to avoid excessive branching or crosslinking in the product, which could lead to undesirable gel formation. Such problems may be avoided by careful control of reaction conditions such as control of the ratio of reagents and the order of their addition, performing the reaction under suitably dilute conditions, and reacting under low acid conditions. These conditions can be determined by the person skilled in the art with only routine experimentation.

The condensation reaction between the phosphorus acid or ester and the diol may be accomplished by mixing the reagents and heating until the reaction is substantially complete. If a methyl ester of the phosphorus acid is used as a reagent, substantial completion of the reaction may correspond with the cessation of evolution and distillation of methanol from the reaction mixture. Suitable temperatures include those in the range of 100 to 140° C., such as 110 to 130° C. or 115 to 120° C. If reaction temperatures in excess of about 140° C. are employed, there is a risk that the desired product may not be formed in useful yields or with useful purity, since competing reactions may occur. Reaction times may typically be up to 12 hours, depending on temperature, applied pressure (if any), agitation, and other variables. In some instances reaction times of 2 to 8 hours or 4 to 6 hours may be appropriate.

The relative molar amounts of the reactants may be a useful parameter. If two difunctional reactants, such as a diol and a dialkyl phosphite, are reacted, a molar ratio of exactly or approximately 1:1 may be useful for producing a relatively high molecular weight polymer. An exact 1:1 ratio could theoretically lead to extremely long chain formation and consequently very high molecular weight. In practice, however, this is not always attained since competing reactions and incompleteness of reaction will provide materials of a lesser degree of polymerization. Incorporation of 5 phosphorus units or more is often observed. Thus, for such reactions, a molar ratio of about 1:1, that is, 0.9:1 to 1.1:1 in the reactants is often desirable, which will be reflected in a similar ratio in the polymeric product.

If the phosphorus compound is a trialkyl phosphite, having potentially three reactive sites, the situation becomes a bit more complicated, as the additional functionality increases the possibility of crosslinking to form apparently insoluble products. It has been found that for such materials, reaction mixtures with a molar ratio of phosphorus compound:diol of 1:1 and up to 1.25:1 may be susceptible to formation of insoluble gels or solids. However, it is believed that in some circumstances the apparently insoluble or gel-like material may be adequately dispersible by suitable chemical or mechanical means. Nevertheless, to minimize this issue, when the monomeric phosphorus acid or ester comprises a trialkyl phosphite, it may be desirable that the ratio is greater than 1.25:1, for instance, 1.3:1 to 1.6:1 or 1.3:1 to 1.4:1. Alternatively, it is contemplated that a ratio of less than 1:1, such as 0.7:1 to 0.9:1 or about 0.8:1, may be used.

It is also possible to use mixtures of dialkyl phosphites and trialkyl phosphites as reactants. If the reaction mixture contains more than about 50 mole percent of trialkyl phosphite, the reaction may be susceptible to gel formation, much as described above, and a molar excess of phosphorus compound may again be profitably employed. The specific ratios may be readily determined by the person skilled in the art. In certain embodiments, there may be 5 to 50 mole percent trialkyl phosphite, or 10 to 40 mole percent or 15 to 35 mole percent trialkyl phosphite in the phosphite mixture, the balance typically being dialkyl phosphite. In an example, 10 mole percent triethyl phosphite may be used in combination with 90 mole percent dimethyl phosphite. Such a mixture may be reacted with, for instance, hexanediol in a molar ratio of phosphites to diol of, e.g., 1:1 to 1.6:1 or 1.1:1 to 1.6:1, or 1.2:1 to 1.5:1, or 1.25:1 to 1.4:1.

Other monomers may be included within the reaction mixture if desired. In particular, the inclusion of a polycarboxylic acid, such as a dicarboxylic acid, is sometimes seen as beneficial. For example, inclusion of a relatively minor amount of tartaric acid or citric acid may provide products with useful properties. The amount of polyacid or diacid may the an amount suitable to incorporate at least 1, or approximately 1, monomeric unit of poly- or dicarboxylic acid per product polymer molecule. The amount of polyacid or diacid actually charged to the reaction mixture may be higher than this amount. Without intending to be bound by any theory, it is believed that when a minor amount of tartaric acid is present, it may be incorporated as an end unit of the polymer, possibly being condensed through an ester linkage with an OH group of an alkylene diol. Such materials may exhibit very good performance in terms of antiwear protection and corrosion inhibition, as well as seals performance. Suitable polyacids (or their esters or anhydrides) include maleic acid, fumaric acid, tartaric acid, citric acid, phthalic acid, terephthalic acid, malonic acid (e.g., ester), succinic acid, malic acid, adipic acid, oxalic acid, sebacic acid, dodecanedioic acid, glutaric acid, and glutamic acid. Another type of monomer which may be included is a monocarboxylic acid which contains a reactive hydroxy group, or a reactive equivalent of such a material, such as an anhydride, ester, or lactone. Examples include glyoxylic acid, caprolactone, valerolactone, and hydroxystearic acid.

Since there is interest in providing lubricant formulations having low ash (low metal content), in certain embodiments the polymeric phosphorus ester is not a metal-containing material and may be, for instance, not in the form of a zinc salt. In certain applications, for instance, automatic transmission applications, the presence of zinc-containing materials may be detrimental to performance. It is believed that such materials may degrade the performance of wet clutches, possibly by plugging pores of the friction material used therein.

In certain embodiments, the lubricant compositions of the present invention are Newtonian fluids or substantially Newtonian fluids. That is to say, their viscosity will be relatively independent of applied shear or, alternatively, their rate of flow will be approximately proportional to the applied shear, apart from the deviations from Newtonican behavior that may be imparted by the presence of a viscosity modifier, which is permitted as described below. In other words, in certain embodiments, the present lubricant compositions are not greases, not materials which flow and lubricate under shear but remain stationary and solid-like in the absence of shear. Conditions of grease manufacture are known to those skilled in the art and generally involve treatment or thickening of a base oil with a thickener, also referred to as a gelling agent or soap. Gelling agents include fatty acid (e.g., C12-20) soaps of metals such as Li, Ca, Na, Al, and Ba, as well as surface coated, finely divided clay particles. It is believed that in greases, oil is maintained within a fibrous structure formed by the gelling agent.

The amount of the polymeric phosphorus ester used in the present lubricants is an amount sufficient to provide 0.01 to 0.3 or to 0.1 weight percent phosphorus to the composition or, in other embodiments, 0.02 to 0.07 weight percent or 0.025 to 0.05 weight percent. The actual amount of the polymeric phosphorus ester which corresponds to these amounts of phosphorus will, of course, depend upon its phosphorus content. If the polymer contains about 16 percent by weight phosphorus, for example, a suitable amounts of the ester in the composition may be 0.06 to 2.0 or to 0.6 weight percent.

The lubricant compositions described herein may contain other components and additives which are conventionally used in lubricants of the desired end use, such as typically transmission lubricants. Such additives are described in greater detail in U.S. Patent Application Publication US-2006-0172899.

One component frequently used is a viscosity modifier. Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers. Some commercially available VMs and DVMs include polyisobutylenes, olefin copolymers, hydrogenated styrene-diene copolymers, styrene/maleate copolymers, polymethacrylates, some of which have dispersant properties, olefin-graft-polymethacrylate polymers, and hydrogenated polyisoprene star polymers. The VMs and/or DVMs may be incorporated into the fully-formulated compositions at a level of up to 15% by weight, e.g., 1 to 12% or 3 to 10%.

Another material frequently used is a dispersant. Succinimide dispersants, a species of carboxylic dispersants, are prepared by the reaction of a hydrocarbyl-substituted succinic anhydride or reactive equivalent thereof with an amine such as a poly(ethyleneamine). The hydrocarbyl substituent group generally contains an average of at least 8, or 20, or 30, or 35 up to 350, or to 200, or to 100 carbon atoms. In one embodiment, the hydrocarbyl group is derived from a polyalkene such as polyisobutene which may have an $\overline{M}_n$ (number average molecular weight) of at least 500, e.g., 500, or 700, or 800, or 900 up to 5000, or to 2500, or to 2000, or to 1500. In one embodiment the polydispersity ($\overline{M}_w/\overline{M}_n$) is at least 1.5. The substituted succinic acylating agent can be reacted with an amine, including those amines described above and heavy amine products known as amine still bottoms. The amount of amine reacted with the acylating agent is typically an amount to provide a mole ratio of CO:N of 1:2 to 1:0.75. If the reaction is, rather, with an alcohol, the resulting dispersant will be an ester dispersant. If both amine and alcohol functionality are present, whether in separate molecules or in the same molecule (as in the above-described condensed amines), mixtures of amide, ester, and possibly imide functionality can be present. These are the so-called ester-amide dispersants.

"Amine dispersants" are reaction products of relatively high molecular weight aliphatic or alicyclic halides and amines, such as polyalkylene polyamines. "Mannich dispersants" are the reaction products of alkyl phenols in which the alkyl group contains at least 30 carbon atoms with aldehydes (especially formaldehyde) and amines (especially polyalkylene polyamines).

Post-treated dispersants may also be used. They are generally obtained by reacting a carboxylic (e.g., succinimide), amine or Mannich dispersant with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Mixtures of dispersants can also be used.

The amount of dispersant or dispersants in the compositions, may be, for instance, 0.3 to 10 percent by weight. In other embodiments, the amount is 0.5 to 7 percent or 1 to 5 percent of the final blended fluid formulation. In a concentrate, the amounts will be proportionately higher.

Another component that may be used in the present composition is a friction modifier. Friction modifiers are well known to those skilled in the art and include such materials as fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines, condensation products of carboxylic acids and polyalkylene-polyamines, metal salts of alkyl salicylates, amine salts of alkylphosphoric acids, and mixtures thereof. Representatives of each of these types of friction modifiers are known and are commercially available, and are described in greater detail in the aforementioned US-2006-0172899.

Among the amine friction modifiers described in the above U.S. Application are tertiary amines of the general structure $R^1R^2NR^3$ where $R^3$ can be a polyol-containing alkyl group (that is, a group containing 2 or more hydroxy groups) or a group containing one or more hydroxy groups and one or more amine groups. For instance, $R^3$ may be —$CH_2$—CHOH—$CH_2OH$ or a homologue thereof, containing, for example, 3 to 8 carbon atoms or 3 to 6 carbon atoms or 3 to 4 carbon atoms, and 2, 3, 4 or more hydroxy groups (normally no more than one hydroxy group per carbon atom). A typical resulting product may thus be represented by $$R^1R^2N—CH_2—CHOH—CH_2OH$$

or homologues thereof, where $R^1$ and $R^2$ are independently alkyl groups of 8 to 20 carbon atoms. Such products may be obtained by the reaction of a dialkyl amine with an epoxide or chlorohydroxy compound. For example, reaction of a secondary amine with glycidol (2,3-epoxy-1-propanol) or "chloroglycerine" (that is, 3-chloropropane-1,2-diol) may be effective. Such materials based on the reaction of dicocoamine with one or more moles of glycidol or chloroglycerine are useful in providing friction-modifying performance. If reaction is with multiple moles of glycidol or chloroglycerine, or other epoxyalkanols or chlorodiols, a dimeric or oligomeric ether-containing group, that is, a hydroxyl-substituted alkoxyalkyl group, may result.

The compositions may also include a detergent, that is, a metal salt of an organic acid containing an oleophilic moiety. The organic acid portion of the detergent is typically a sulfonate, carboxylate, phenate, or salicylate. The metal portion of the detergent is typically an alkali or alkaline earth metal. Suitable metals include sodium, calcium, potassium, and magnesium. Typically, the detergents are overbased, meaning that there is a stoichiometric excess of metal over that needed to form the neutral metal salt. Suitable overbased organic salts include organic sulfonate salts having a substantially oleophilic character. Organic sulfonates are well known materials in the lubricant and detergent arts. The sulfonate compound may contain on average 10 to 40 carbon atoms, or 12 to 36 or 14 to 32 carbon atoms on average. Similarly, the phenates, salicylates, and carboxylates have a substantially oleophilic character.

The detergent may be "overbased." By overbasing, it is meant that a stoichiometric excess of the metal be present over that required to neutralize the acid and form a neutral salt. The excess metal from overbasing has the effect of neutralizing acids which may build up in the lubricant. A second advantage is that the overbased salt may increase the dynamic coefficient of friction. Typically, the excess metal will be present over that which is required to neutralize the acid in the ratio of up to 30:1, preferably 5:1 to 18:1 on an equivalent basis.

The amount of the overbased salt utilized in the composition may be typically 0.025 to 3 weight percent on an oil free basis, e.g., 0.1 to 1.0 percent. The overbased salt is usually made up in about 50% oil with a TBN range of 10-600 on an oil free basis. Borated and non-borated overbased detergents are described in U.S. Pat. Nos. 5,403,501 and 4,792,410.

The compositions of the present invention may also include at least one phosphorus acid, phosphorus acid salt, phosphorus acid ester or derivative thereof including sulfur-containing analogs in the amount of 0.002-1.0 weight percent (other than and in addition to the polymeric phosphorus ester described above). The phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof. In one embodiment, the phosphorus acid, ester or derivative can be an organic or inorganic phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids. One group of phosphorus compounds are alkylphosphoric acid mono alkyl primary amine salts. Compounds of this type are described in U.S. Pat. No. 5,354,484. Eighty-five percent phosphoric acid is a suitable material for addition to the fully-formulated compositions and can be included, if desired, at a level of 0.01 to 0.3 weight percent based on the weight of the composition, such as 0.03 to 0.2 or to 0.1 percent.

Other materials can optionally be included in the compositions, provided that they are not incompatible with the aforementioned required components or specifications. Such materials include antioxidants (that is, oxidation inhibitors), including hindered phenolic antioxidants, secondary aromatic amine antioxidants such as dinonyldiphenylamine as well as such well-known variants as monononyldiphenylamine and diphenylamines with other alkyl substituents such as mono- or di-octyl, sulfurized phenolic antioxidants, oil-soluble copper compounds, phosphorus-containing antioxidants, and organic sulfides, disulfides, and polysulfides such as 2-hydroxyalkyl,alkyl thioethers or 1-t-dodecylthio-2-propanol or sulfurized 4-carbobutoxycyclohexene or other sulfurized olefins. Other optional components include seal swell compositions, such as isodecyl sulfolane or phthalate esters, which are designed to keep seals pliable. Also permissible are pour point depressants, such as alkylnaphthalenes, polymethacrylates, vinyl acetate/fumarate or /maleate copolymers, and styrene/maleate copolymers. Another material is an anti-wear agent such as zinc dialkyldithiophosphates. These optional materials are known to those skilled in the art, are generally commercially available, and are described in greater detail in published European Patent Application 761,805. Also included can be known materials such as corrosion inhibitors (e.g., tolyltriazole, dimercaptothiadiazoles), dyes, fluidizing agents, odor masking agents, and antifoam agents. Organic borate esters and organic borate salts can also be included.

The above components can be in the form of a fully-formulated lubricant or in the form of a concentrate within a smaller amount of lubricating oil. If they are present in a concentrate, their concentrations will generally be directly proportional to their concentrations in the more dilute form in the final blend.

The above-described lubricant composition may be used for lubricating a mechanical device, by supplying thereto the lubricant. The mechanical devices which may benefit from the present lubricant are not particularly limited but may include internal combustion engines (including gasoline or diesel fueled or mixed fuel engine or hybrid engines), gears, hydraulic systems, and transmissions, including automatic transmissions, manual transmissions, and variants thereof such as dual clutch transmissions and continuously variable transmissions, including push-belt transmissions and traction drives. They are particularly useful in lubricating devices such as transmissions which have elastomeric seals, where their use in improving the seal performance or durability may be an advantage.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain atoms other than carbon in a ring or chain otherwise composed of carbon atoms. Heteroatoms include sulfur, oxygen, nitrogen, and encompass substituents as pyridyl, furyl, thienyl and imidazolyl. In general, no more than two, or no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

Example 1

Synthesis of dialkylphosphite polymer from 1,6-hexane diol. A mixture of 1:1 mole ratio of 1,6-hexanediol and dimethyl phosphite is prepared and heated to 115-120° C. until removal of alcohol by distillation is complete (about 9 hours). The product contains 19.6 weight percent phosphorus and is a clear, colorless oil with a very mild odor.

Example 2

Synthesis of trialkylphosphite polymer from 1,6-hexanediol. Substantially the same procedure is followed as for example 1 except that triethyl phosphite is employed as the phosphorus compound. The mole ratio of P:diol is 1.35:1 and the reaction temperature is 130° C. The product contains 15.7% phosphorus. (Similar reactions attempted at mole ratios of 1:1 and 1.25:1 lead to solid or gelled materials which are not further investigated.)

Example 3-8

Synthesis of dialkylphosphite polymers from dimethyl phosphite and a variety of diols. Substantially the same procedure is followed as for examples 1-2. The P:diol ratio is 1:1.

| Ex | Diol | Reaction temp, ° C. | Reaction time, hr |
|---|---|---|---|
| 3 | 1,6-hexanediol[a] | 115-120 | 5 |
| 4 | 1,4-butanediol | 115-120 | 2 |
| 5 | diethylene glycol | 120-130 | 4.5 |
| 5a | diethylene glycol | 125 | 5 |
| 6 | triethylene glycol | 120-130 | 5 |
| 7 | 1,6-hexanediol with 10 mol % tartaric acid[b] | 120-130 | 4.5 |
| 8 | 1,6-hexanediol with 3 mol % tartaric acid[c] | 120-130 | 4 |

[a]Reaction mixture contains 0.4 mol % NaOMe as catalyst
[b]Tartaric acid replaces 10 mole % of the dimethyl phosphite.
[c]Tartaric acid replaces 3 mole % of the dimethyl phosphite.

Examples 9-20

Certain of the above polymeric phosphorus esters are tested in a typical automatic transmission formulation (Formulation 1). The formulations are prepared in a base oil of Chevron™ RLOP 100 Neutral oil containing 9 wt. % (including diluent oil) of a commercial viscosity index modifier. The formulations further contain 2.9% succinimide dispersant(s), 0.8% antioxidant(s), 0.3% fatty acid/amine condensation product, 0.1% phosphoric acid (85%), a commercial antifoam agent, and an antiwear agent in an amount to provide 0.06% by weight phosphorus. The antiwear agents are selected from among the materials of examples 1-8, above, or, as a reference, dibutyl phosphite, a conventional monomeric antiwear agent.

The formulations to be tested for their effect on a variety of seals. Three pieces of seal material are cut according to ASTM D 412 for each elastomeric material tests. Initial properties of each material are taken as an average of the three test pieces. Properties measured are initial volume in air, initial volume in water (ASTM D 471), and Shore A hardness (ASTM D 2240). The seal pieces are suspended in 150 mL of the test liquid and held at 150° C. for 168 hours, in accordance with ASTM D 471. After the 168 hours, the seal materials are removed, allowed to cool for 30 minutes, and wiped clean of excess oil. Shore A hardness, volume in air, and volume in water are again measured. For measurement of tensile strength and elongation, samples of the elastomer materials, before and after testing, are stretched to the breaking point according to ASTM D 412.

The effect of the formulations on "ACM" (acrylic rubber) seals is initially evaluated in terms tensile strength. A significant improvement in the tensile strength measurement is observed, as shown in the table below. (For this test, no improvement is observed in volume, hardness, or elongation measurements.)

| Example | Product from diol: | Tensile strength change, %, ACM seal |
|---|---|---|
| 9 (comparative) | (Dibutyl phosphite, unreacted) | −4.7 |
| 10 | 1,6-Hexanediol as in Ex. 1 | +4.8 |
| 11 | Diethylene glycol as in Ex. 5 | −0.9 |
| 12 | Triethylene glycol as in Ex. 6 | +3.9 |
| 13 | 1,6-Hexanediol with 10% tartaric acid as in Ex. 7 | +3.5 |
| 14 | 1,6-Hexanediol with 3 mol % tartaric acid as in Ex. 8 | +4.2 |

Thus the materials of the present invention show particular merit when tested against degradation of tensile strength of ACM seals.

When the same test is run using "VMQ" (silicone rubber) seals, several of the test results are comparable to those obtained with the comparative dibutyl phosphite. However, two of the materials tested, the product with triethylene glycol and the product with hexanediol and 10% tartaric acid, show significant improvements in both tensile strength and elongation, as shown in the table below:

| | | % Change, VMQ seal | |
|---|---|---|---|
| Example | Product from diol: | Tensile strength | Elongation |
| 15 (comp.) | (Dibutyl phosphite, unreacted) | −10.9 | −6.2 |
| 16 | 1,6-Hexanediol as in Ex. 1 | −9.2 | −8.9 |
| 17 | Diethylene glycol as in Ex. 5 or 5a | −11.2 | −8.2 |
| 18 | Triethylene glycol as in Ex. 6 | −7.5 | −2.8 |
| 19 | 1,6-Hexanediol with 10% tartaric acid as in Ex. 7 | −7.1 | −1.5 |
| 20 | 1,6-Hexanediol with 3 mol % tartaric acid as in Ex. 8 | −11.2 | −7.4 |

Similar testing on "FKM" (fluoroelastomer) seals in the above formulation shows comparable performance to that of dibutyl phosphite. While the materials will show differing degrees of advantage depending on the specific formulation in which they are used and depending on the specific seal material against which they are tested, they will typically also exhibit advantages of reduced volatility, odor, and in some embodiments toxicity, due to their higher molecular weights.

Examples 21-26

Certain materials are tested in a second lubricant formulation (Formulation 2). The formulations are prepared in a mixture of base oils having 100° C. viscosities of 3.0 to 7.2 $mm^2/s$ (cSt) and containing 6.9 wt % (including diluent oil) commercial methacrylate viscosity index modifiers and 0.2 wt % (including oil) pour point depressant. The formulations further contain 3.3 wt % succinimide dispersant(s) (oil free basis), 1.02 wt % antioxidant(s), 0.18 wt % fatty acid/amine condensation product(s), 0.09 wt % phosphoric acid (85%), 0.20 wt % overbased Ca sulfonate detergent(s) (oil free basis), 0.10 wt % corrosion inhibitors, 1.66% seal swell agent, 0.46 wt % ester lubricity agent, 1.47 wt % of amine, amide, and borate ester friction modifiers, 0.03 wt % ethoxylated amine, and 0.08 wt % monomeric fatty alkyl phosphite. To this Formulation 2 is added 0.22 or 0.23 wt %, respectively, of dibutyl phosphite (dibutyl hydrogen phosphonate) or poly (diethyleneglycol phosphite) as from Example 5a.

The two samples are tested for seal performance in the test as described above, for ACM and VMQ seals. As in Formulation 1, there is little or no change in volume or hardness of the seals, but there is a significant improvement in tensile strength for the ACM seal and a dramatic improvement in both measurements for the VMQ seal. Results are shown in the following table:

| | Ex | | | |
|---|---|---|---|---|
| | 21* | 22 | 23* | 24 |
| Dibutyl phosphite, % | 0.22 | | 0.22 | |
| Poly(diethylene glycol phosphite), % | | 0.23 | | 0.23 |
| % P | 0.060 | 0.066 | 0.060 | 0.066 |
| Seal material | ACM | ACM | VMQ | VMQ |
| Tensile change, % | −1.7 | +5.5 | −62.8, | −18.5, |

-continued

| | Ex | | | |
|---|---|---|---|---|
| | 21* | 22 | 23* | 24 |
| Elongation change, % | −25.4 | −25.2 | —[b] −61.9, —[b] | −20[a] −8.9, −16[a] |

*A comparative example
[a]repeated run
[b]in a repeated run, the VMQ rubber crumbles upon removal from the test bath.

The formulations containing the polymeric phosphite materials are also evaluated for wear performance. When examined in simple bench tests such as the Mercon 4-ball test or the Falex block-on-ring test, in general, the polymeric materials will give similar results to the incumbent antiwear material, dibutyl phosphite. While in some cases there will be a modest improvement, we are unable to state that the results will be dramatically or consistently either better or worse than dibutyl phosphite in these tests.

However, certain of the present materials were evaluated in a four-roller pitting test which is more fully representative of wear performance in a transmission, as both rolling and sliding contact is tested and observed. In this test a four-roller rig is employed. The test configuration consists of a test roller surrounded by three larger rings loaded against the test roller, resulting in three contact points on the test roller. The central test roller and surrounding rings are independently rotated, providing the ability to control the slide-to-roll ratio. The test roller and rings are manufactured from 16MnCr5 steel and are case carburized, ground, and hardened to surface roughness and hardness values characteristic of common gear materials. The surfaces are splash-lubricated with a volume of 150 mL test fluid, at 100° C., using 2.5 GPa contact pressure, a rolling velocity of 2.5 m/s, and a slide/roll ratio of 20%. The formulations of Example 21 (comparative, with dibutyl phosphite) and Example 22 (poly(diethylene glycol phosphite)), each in base Formulation 2, are subjected to this test. The results are shown in the Table below.

| | Ex | |
|---|---|---|
| | 25* | 26 |
| Dibutyl phosphite, % | 0.22 | |
| Poly(diethylene glycol phosphite), % | | 0.23 |
| Four roller test, end-of-test time, hr | 8 | 15 |

*Comparative example

For Comparative Example 25, the test is terminated at 8 hours because of the presence of a large surface pit. For Example 26, however, with the poly(diethylene glycol phosphite), the test is continued for 15 hours. Upon examination, the surfaces show the expected wear but no evidence of macropitting. This result is characteristic of a good antiwear agent.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a drivetrain component, comprising supplying thereto a lubricant composition comprising:

(a) an oil of lubricating viscosity and (b) a polymeric phosphorus ester other than a zinc salt, comprising the condensation product of (i) a monomeric phosphorus acid or an ester thereof with (ii) an alkylene diol wherein the two hydroxy groups of said alkylene diol are separated by a chain of 4 to about 20 carbon atoms, said polymeric phosphorus ester containing at least three phosphorus-containing monomer units;

wherein the monomeric phosphorus acid or ester thereof comprises a trialkyl phosphite.

2. The method of claim 1 wherein the monomeric phosphorus acid or ester thereof comprises a trialkyl phosphite and wherein the ratio of the moles of trialkyl phosphite to the moles of diol is greater than about 1.25:1.

3. The method of claim 1 wherein the alkyl groups of the trialkyl phosphite each independently contain 1 to about 6 carbon atoms.

4. The method claim 1 wherein the monomeric phosphorus acid or ester thereof comprises a dialkyl phosphite and a trialkyl phosphite.

5. The method claim 1 wherein the polymeric phosphorus ester comprises molecules containing 5 to about 500 phosphorus-containing monomer units.

6. The method of claim 1 wherein the polymeric phosphorus ester comprises molecules containing 5 to about 15 phosphorus-containing monomer units.

7. The method of claim 1 wherein said alkylene diol is selected from the group consisting of butanediol and hexanediol.

8. The method of claim 1 wherein the ratio of the moles of monomeric phosphorus acid or ester to the moles of alkylene diol is about 0.9:1 to about 1.1:1.

9. The method of claim 1 wherein the amount of the polymeric phosphorus ester is an amount to provide about 0.01 to about 0.3 weight percent phosphorus to the composition.

10. The method of claim 1 wherein the amount of the polymeric phosphorus ester is about 0.06 to about 2.0 weight percent of the composition.

11. The method of claim 1 wherein the lubricant composition further comprises at least one dispersant, viscosity modifier, or antioxidant.

12. The method of claim 1 wherein said drivetrain component is a transmission.

13. A method for lubricating a drivetrain component, comprising supplying thereto a lubricant composition comprising:

(a) an oil of lubricating viscosity and (b) a polymeric phosphorus ester other than a zinc salt, comprising the condensation product of (i) a monomeric phosphorus acid or an ester thereof with (ii) an alkylene diol wherein the two hydroxy groups of said alkylene diol are separated by a chain of 4 to about 20 carbon atoms, said polymeric phosphorus ester containing at least three phosphorus-containing monomer units wherein the polymeric phosphorus ester further comprises (iii) at least one monomer unit of a polycarboxylic acid.

14. The method of claim 13 wherein said polycarboxylic acid comprises tartaric acid or citric acid and wherein at least a portion of said tartaric acid or citric acid is present as an end unit of the polymer, being condensed through an ester linkage with an OH group of an alkylene diol.

15. The method of claim 13 wherein the monomeric phosphorus acid or ester thereof comprises a dialkyl phosphite.

16. The method of claim 15 wherein the alkyl groups of the dialkyl phosphite each independently contain 1 to about 6 carbon atoms.

17. The method of claim 13 wherein said alkylene diol is selected from the group consisting of butanediol and hexanediol.

18. The method of claim 13 wherein the ratio of the moles of monomeric phosphorus acid or ester to the moles of alkylene diol is about 0.9:1 to about 1.1:1.

19. The method of claim 13 wherein the amount of the polymeric phosphorus ester is an amount to provide about 0.01 to about 0.3 weight percent phosphorus to the composition.

20. The method of claim 13 wherein the lubricant composition further comprises at least one dispersant, viscosity modifier, or antioxidant.

* * * * *